US007129913B2

(12) United States Patent
Moon

(10) Patent No.: US 7,129,913 B2
(45) Date of Patent: Oct. 31, 2006

(54) ELECTROLUMINESCENCE PANEL DISPLAY APPARATUS AND DRIVING METHOD THEREOF

(75) Inventor: Seong Hak Moon, Yongin (KR)

(73) Assignee: LG Electronics Inc., Seoul (KR)

( * ) Notice: Subject to any disclaimer, the term of this patent is extended or adjusted under 35 U.S.C. 154(b) by 495 days.

(21) Appl. No.: 10/201,787

(22) Filed: Jul. 25, 2002

(65) Prior Publication Data

US 2003/0058198 A1 Mar. 27, 2003

(30) Foreign Application Priority Data

Sep. 21, 2001 (KR) ..... 2001-58636

(51) Int. Cl.
*G09G 3/30* (2006.01)

(52) U.S. Cl. ..... 345/76; 345/77; 345/78; 345/83; 345/84

(58) Field of Classification Search ..... 345/76–98; 313/506; 349/42, 74, 139–152
See application file for complete search history.

(56) References Cited

U.S. PATENT DOCUMENTS

| | | | | |
|---|---|---|---|---|
| 5,917,280 | A * | 6/1999 | Burrows et al. | 313/506 |
| 6,121,943 | A * | 9/2000 | Nishioka et al. | 345/76 |
| 6,304,243 | B1 * | 10/2001 | Kondo et al. | 345/100 |
| 6,358,631 | B1 * | 3/2002 | Forrest et al. | 428/690 |
| 6,366,025 | B1 * | 4/2002 | Yamada | 315/169.3 |
| 6,476,899 | B1 * | 11/2002 | Ishida et al. | 349/139 |
| 6,727,871 | B1 * | 4/2004 | Suzuki et al. | 345/76 |
| 6,747,618 | B1 * | 6/2004 | Arnold et al. | 345/77 |
| 2001/0038427 | A1 * | 11/2001 | Ueda et al. | 349/74 |

* cited by examiner

*Primary Examiner*—Vijay Shankar
(74) *Attorney, Agent, or Firm*—Fleshner & Kim LLP

(57) ABSTRACT

An electroluminescence (EL) panel display and its driving method are capable of easily setting a color balance and improving a luminance, for which an EL panel includes a first substrate having a plurality of red and green inorganic materials thereon and a second substrate having a plurality of blue inorganic materials overlapped with the red and green inorganic materials.

17 Claims, 7 Drawing Sheets

ELECTROLUMINESCENCE PANEL DISPLAY APPARATUS AND DRIVING METHOD THEREOF

BACKGROUND OF THE INVENTION

1.Field of the Invention

The present invention relates to an electroluminescence (EL) display apparatus and its driving method, and more particularly, to an EL panel display apparatus and its driving method that are capable of easily setting a color balance and improving a luminance.

2.Description of the Background Art

Recently, various panel display devices are being developed to reduce a weight and a volume of a cathode ray tube. The panel display devices include a field emission display (FED), a plasma display panel (PDP) and an electro-luminescence (EL) display.

The EL display utilizes an EL phenomenon that a light is generated by a voltage applied to a phosphor layer. Thanks to its rapid response speed, low DC drive voltage and capability of being ultra-thin compared to such an LCD, the EL display can be adoptable to a wall-hanging type product or a portable product.

The EL displays are classified into an inorganic EL display and an organic EL display depending on its material and structure.

FIG. 1 is a drawing illustrating the cell structure of the inorganic EL panel in accordance with a conventional art.

As shown in FIG. 1, the cell 10 of the inorganic EL panel includes: an upper insulation layer 4 and a lower insulation layer 2, a phosphor layer 3 formed between the lower and upper insulation layers 2 and 4, a back electrode 1 formed on the lower insulation layer 2, and a clear electrode 5 formed on the upper insulation layer 4. The clear electrode 5 is formed at a rear surface of a glass substrate 6.

The upper and lower insulation layers 2 and 4 are made of a dielectric material. Thus, when a voltage is applied to the cell 10, the upper and lower insulation layers 2 and 4 have a certain capacitance.

The phosphor layer 3 is excited by electrons to emit a visible light. The phosphor layer 3 is made of an inorganic substance such as Zns or Mn.

The back electrode 1 is made of a conductive material such as Al. The back electrode 1 receives a scan pulse from a gate driving unit (not shown). That is, the back electrode 1 is used as a scan electrode for supplying the scan pulse to the cells 10.

The clear electrode 5 is made of a clear conductive material such as Indium-Tin-Oxide (ITO). The clear electrode 5 receives a data pulse from a data driving unit (not shown). That is, the clear electrode 5 is used as a data electrode for supplying the data pulse to the cells.

When the scan pulse is supplied to the back electrode 1 and the data pulse is applied to the clear electrode 5 (that is, a voltage is applied between the back electrode 1 and the clear electrode 5), holes are accelerated toward the back electrode 1 and electrons are accelerated toward the clear electrode 5. The electrons and the hole collide at the central portion of the phosphor layer 3. When the electrons and the hole collide, the phosphor layer 3 generates a visible light to display a certain image.

FIG. 2 is a drawing illustrating the inorganic EL display in accordance with the conventional art.

As shown in FIG. 2, the conventional inorganic EL display includes: a panel 13 consisting of data lines D1~Dn, scan lines S1~Sm and cells 10 positioned at cross points between the data lines D1~Dn and the scan lines S1~Sm; a data driving unit 12 for supplying a data pulse to the data lines D1~Dn; and a scan driving unit 11 for supplying a scan pulse to the scan lines S1~Sm.

The operation of the conventional inorganic EL display will now be described.

First, the scan driving unit 11 sequentially supplies a scan pulse to the scan lines S1~Sm.

The data driving unit 12 supplies a data pulse in synchronization with the scan pulse to the data lines D1~Dn.

At this time, upon receiving the scan pulse and the data pulse, the pixel cell 10 emits a visible light corresponding to the data pulse to display a picture.

The phosphor layer 3 included in the pixel cell 10 and generating light of red (R), green (G) and blue (B) is made of different materials. That is, red and green fluorescent materials are made of Zns:Mn, and the ratios of Zns and Mn respectively contained in the red and green fluorescent material differ. The blue fluorescent material is made of Cas:Mn.

Zns signifies a compound of zinc and sulfur, Mn signifies manganese, and Cas signifies a compound of calcium and sulfur, which will now be described with reference to FIGS. 3A and 3B.

FIGS. 3A and 3B are graphs showing voltage-luminance characteristics of red, green and blue inorganic materials.

As shown in FIGS. 3A and 3B, comprised of different components, threshold voltages of red, green and blue fluorescent materials are different from each other.

That is, as shown in FIG. 3A, though different depending on the ratio and the amount of the material contained therein, the blue fluorescent material is emitted at a threshold voltage of 120~200V.

As shown in FIG. B, the red and green fluorescent material differ according to a ratio or an amount of a contained material but emits at a threshold voltage between approximately 150~240V.

Thus, in order to make the red, green and blue fluorescent materials to luminesce at the different threshold voltages, a scan pulse with a lower voltage than the lowermost threshold voltage of the different threshold voltages is supplied to the red (R), green (G) and blue (B) fluorescent materials.

At this time, different voltages of the data pulse are supplied to the red, green and blue fluorescent materials to display a picture, for which the data driving unit 12 includes an R driving unit 12A for emitting red light from the red fluorescent material, a G driving unit 12B for emitting green light from the green fluorescent material and a B driving unit 12C for emitting blue light from the blue fluorescent material.

However, disadvantageously, the blue fluorescent material in the EL panel of the conventional art has a considerably short life span compared with that of the red and green fluorescent material.

In addition, the blue fluorescent material of the EL panel of the conventional art has a considerably low luminance compared with that of the red and green fluorescent material. That is, since the luminance of the blue fluorescent material is low compared to that of the red and green fluorescent material, it is difficult to set a color balance.

Moreover, since it is difficult to set the color balance of the fluorescent material of the EL panel, a luminance is degraded.

SUMMARY OF THE INVENTION

Therefore, an object of the present invention is to provide an EL panel display and its driving method that are capable of easily setting a color balance and improving a luminance.

To achieve these and other advantages and in accordance with the purpose of the present invention, as embodied and broadly described herein, there is provided an EL panel including: a first substrate having a plurality of red and green inorganic materials formed thereon; and a second substrate having a plurality of blue inorganic materials overlapped with the plurality of red and green inorganic materials.

To achieve the above objects, there is also provided an EL panel display including: a first substrate having a cell with a blue fluorescent material formed as a matrix type; and a second substrate overlapped with the first substrate and having a cell with a red and green fluorescent materials formed as a matrix type.

To achieve the above objects, there is also provided an EL panel display including: a first data line formed on a first substrate so as to be overlapped with the red and green fluorescent materials; a first scan line formed to be overlapped with the red and green fluorescent materials in a direction of being crossed with the first data line; a second data line formed on a second substrate so as to be overlapped with a blue fluorescent material; and a second scan line formed to be overlapped with the blue fluorescent material in a direction of being crossed with the second data line.

To achieve the above objects, there is also provided an EL panel display including: a first data driving unit for supplying a data pulse to a first data line; a second data driving unit for supplying the data pulse to a second data line; and a scan driving unit for sequentially supplying a scan pulse in synchronization with the data pulse to the first and second scan lines.

To achieve the above objects, there is also provided a driving method of an EL panel consisting of a first substrate having a cell with a blue inorganic material formed thereon; a second substrate overlapped with the first substrate and having a cell with red and green inorganic materials formed thereon; a first data line formed on the first substrate so as to be overlapped with the red and green inorganic materials; a first scan line formed to be overlapped with the red and green inorganic materials in a direction of being crossed with the first data line; a second data line formed on the second substrate overlapped with the blue inorganic material, and a second scan line formed to be overlapped with the blue inorganic material in a direction of being crossed with the second data line, including the steps of: sequentially supplying the scan pulse to the first and second scan lines; and supplying the data pulse to the first and second data lines so as to be synchronized with the scan pulse.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

An EL panel display and its driving method in accordance with a preferred embodiment of the present invention are capable of easily setting a color balance of a fluorescent material and improving a luminance by driving an EL panel consisting of a first substrate having a cell with blue fluorescent material formed thereon; and a second substrate overlapped with the first substrate and having a cell with red and green fluorescent materials formed thereon.

Figure 1:
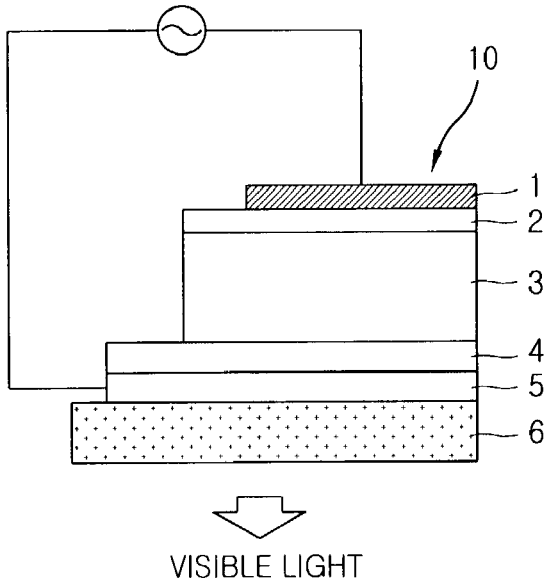
FIG. 1 CONVENTIONAL ART
FIG. 1 is a drawing illustrating a cell structure of an inorganic EL panel in accordance with a conventional art.
Figure 2:
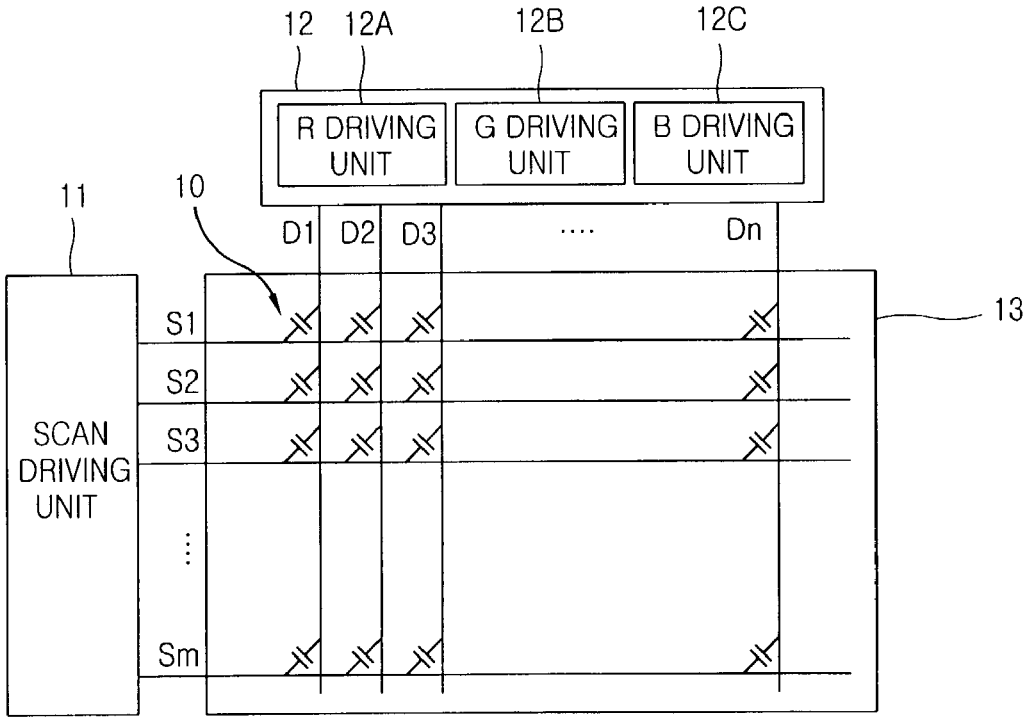
FIG. 2 CONVENTIONAL ART
FIG. 2 is a drawing illustrating an inorganic EL display in accordance with the conventional art.
Figure 3A:
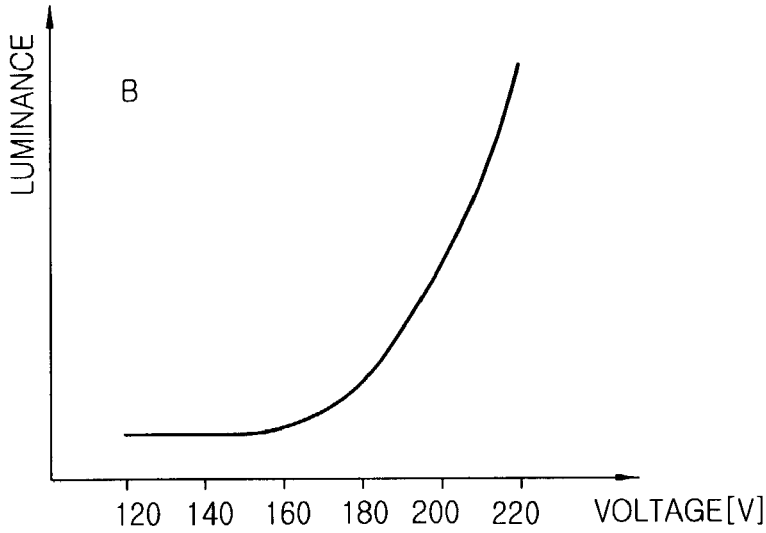
FIG. 3A CONVENTIONAL ART
FIGS. 3A and 3B are graphs showing voltage-luminance characteristics of red, green and blue inorganic materials.
Figure 3B:
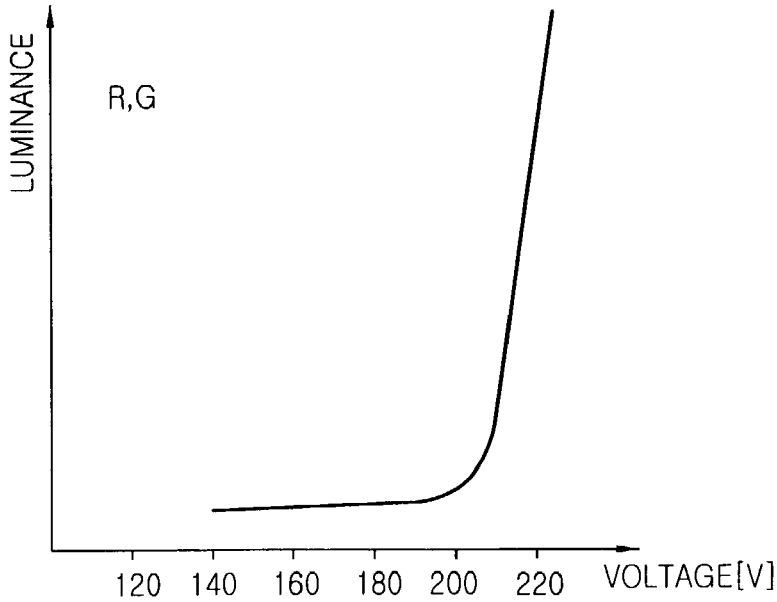
FIG. 3B CONVENTIONAL ART
Figure 4:
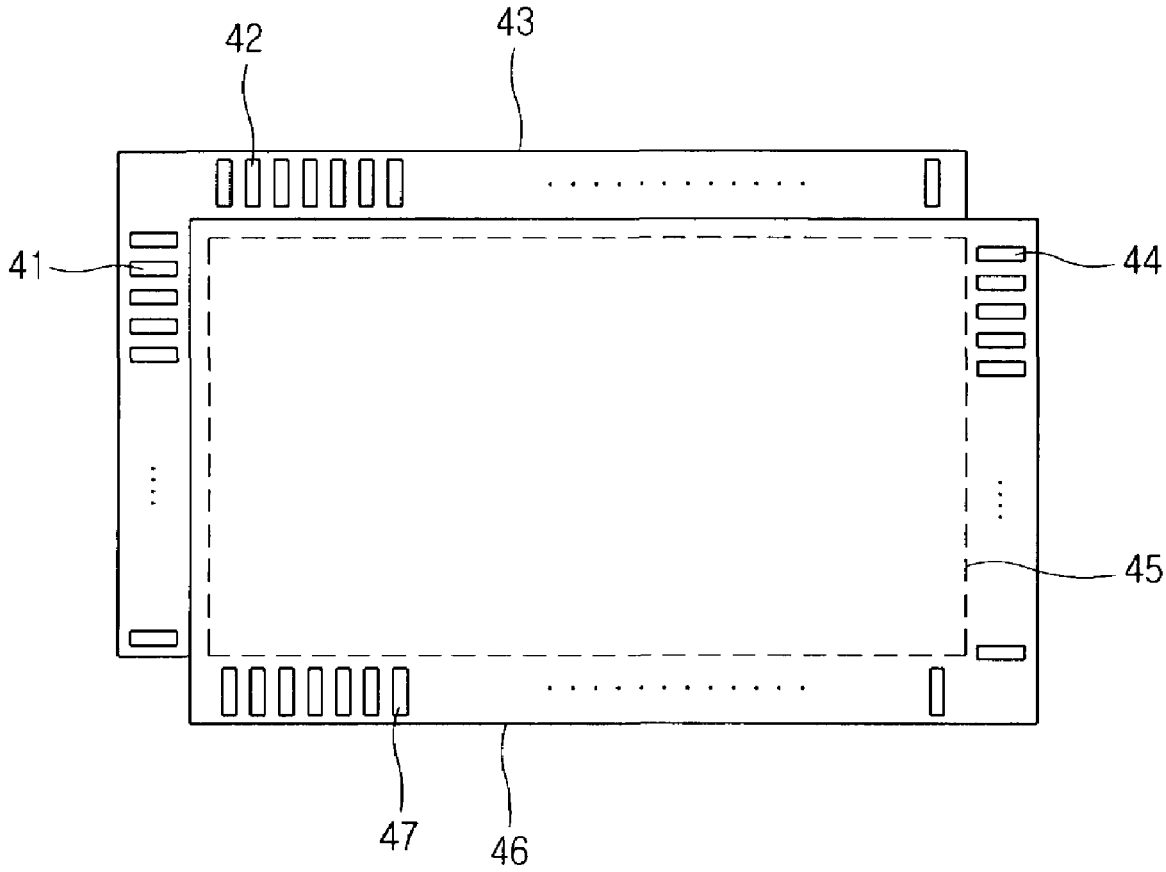
FIG. 4 is a drawing illustrating an inorganic EL panel in accordance with a preferred embodiment of the present invention.

FIG. 4 is a drawing illustrating an inorganic EL panel in accordance with a preferred embodiment of the present invention.

As shown in FIG. 4, an inorganic EL panel of the present invention includes: a first substrate 43 and a second substrate 46 formed to be overlapped for a certain portion at a back surface of the first substrate 43, which will now be described in detail with reference to FIGS. 5A and 5B.

Figure 5A:
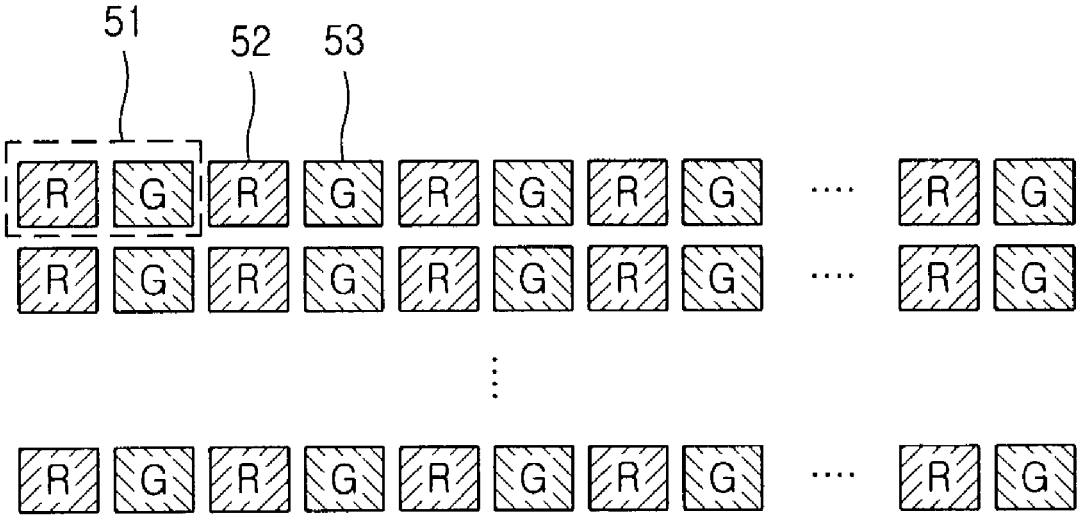
FIG. 5A is a drawing illustrating an arrangement of red and green inorganic materials formed on a first substrate of FIG. 4.
Figure 5B:
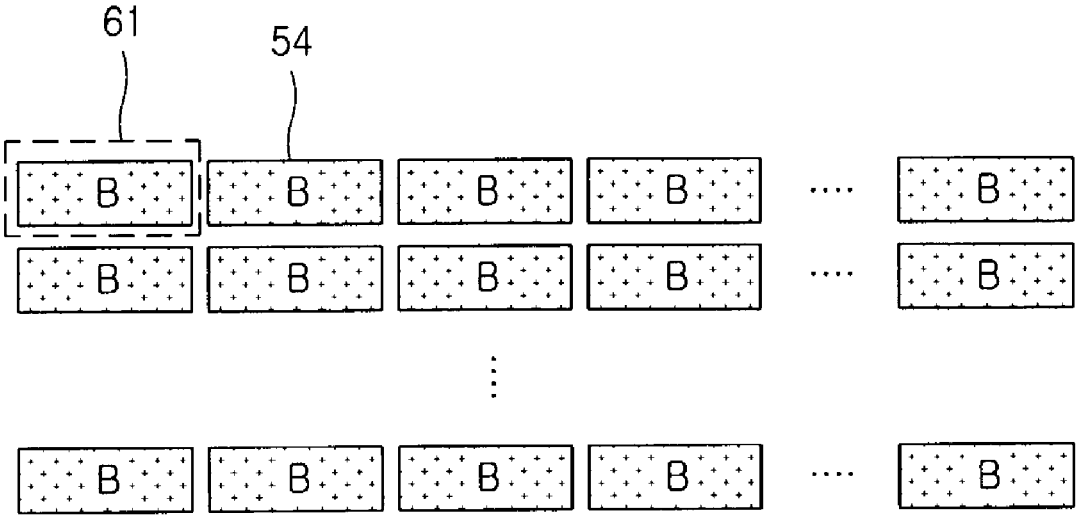
FIG. 5B is a drawing illustrating an arrangement of a blue inorganic material formed on a second substrate of FIG. 4.

FIG. 5A is a drawing illustrating an arrangement of red and green inorganic materials formed on a first substrate of FIG. 4, and FIG. 5B is a drawing illustrating an arrangement of a blue inorganic material formed on a second substrate of FIG. 4.

As shown in FIGS. 4, 5A and 5B, the first substrate 43 and the second substrate 46 are installed in such a manner that they are overlapped at an active display surface 45 for displaying an image.

With reference to FIG. 5A, the plurality of red fluorescent materials (inorganic substances) 52 and green fluorescent material (inorganic substances) are formed as a matrix form on the first substrate 43. That is, only the red (R), the green (G) fluorescent materials (52, 53) are formed as a matrix form at one cell 51 of the first substrate 43.

Comparatively, in the conventional EL panel, red, green and blue fluorescent materials (inorganic substances) are all formed at one cell 10.

Therefore, the red and green fluorescent materials 52 and 53 formed on the first substrate 43 of the EL panel of the present invention are set to have a size larger than that of the fluorescent material of the conventional EL panel, and thus, the red and green luminance can be improved.

A first pad 42 and a second pad 41 are installed at other portion than the active display surface 45 of the first substrate 43.

The first pad 42 is formed at a portion of the first substrate 43 and electrically connected with the data lines (not shown).

The second pad 41 is formed at a portion of the first substrate 43 and electrically connected with scan lines (not shown) formed in a direction of being crossed with the data lines.

Figure 7:
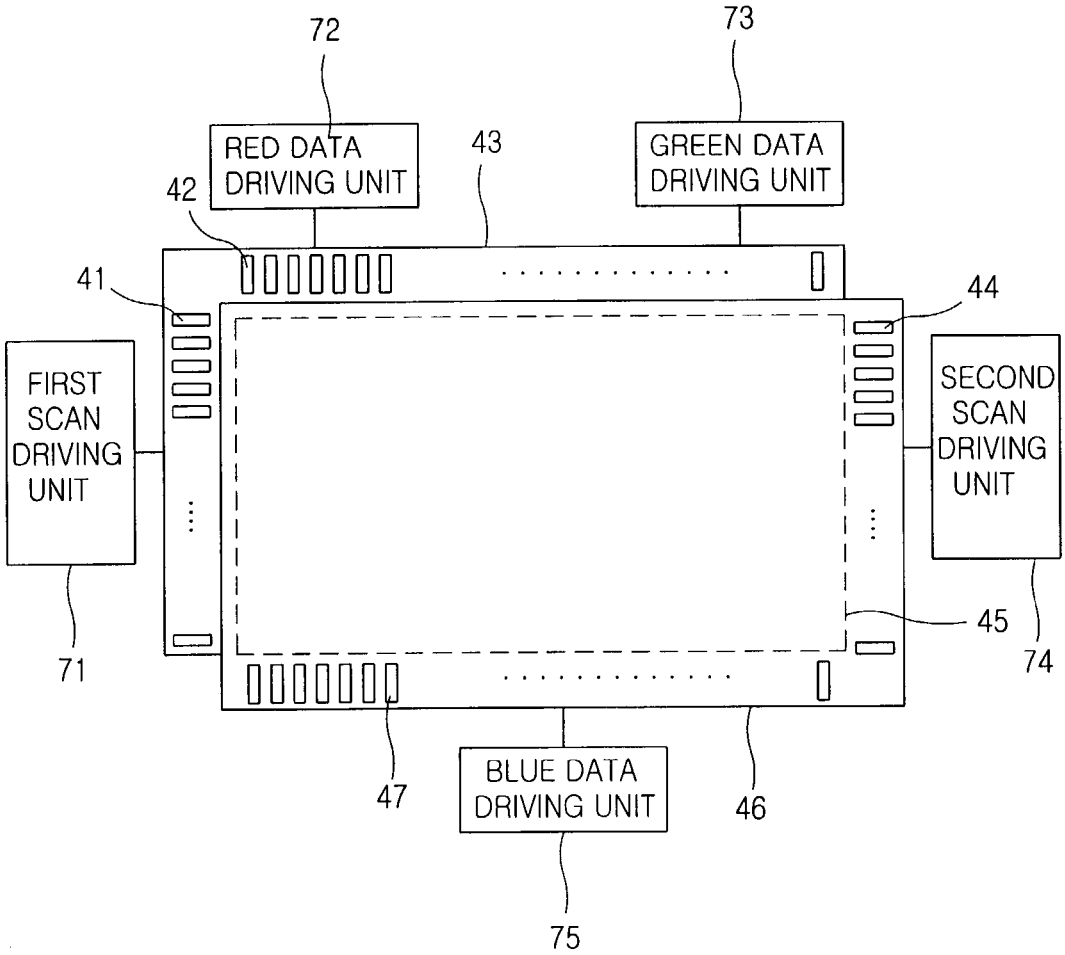
FIG. 7 is a drawing illustrating a driving unit of the inorganic EL panel in accordance with the preferred embodiment of the present invention.

The second pad 41 sequentially receives the scan pulse from the scan driving unit (71 and 74 in FIG. 7).

As shown in FIG. 5B, a plurality of blue (B) fluorescent materials 54 are formed in a matrix form on the second substrate 46 which is overlapped with the first substrate 43 at the active display surface 45. That is, only blue (B) fluorescent material 54 is formed in one cell 61 of the second substrate 46. The size of the blue fluorescent material 54 is determined by the following equation (1):

$$R+G \leqq B \qquad \text{equation (1)}$$

Namely, the size of the blue (B) fluorescent material 54 is set to be the same as or greater than the size obtained by adding the sizes of the red (R) and green (G) fluorescent materials 52 and 53. Thus, as the blue (B) fluorescent material 54 is formed greater than the red (R) and green (G) fluorescent materials 52 and 53, the luminance of the blue (B) fluorescent material 54, which is lower than that of the red and green fluorescent materials 52 and 53, can be compensated.

In other words, by compensating the luminance of the blue (B) fluorescent material 54, the color balance of the red (R), green (G) and blue (B) fluorescent materials 52, 53 and 54 can be easily set.

The fluorescent materials 52, 53 and 54 formed overlapped at active display surface 45 will now be described in detail with reference to FIG. 6.

Figure 6:
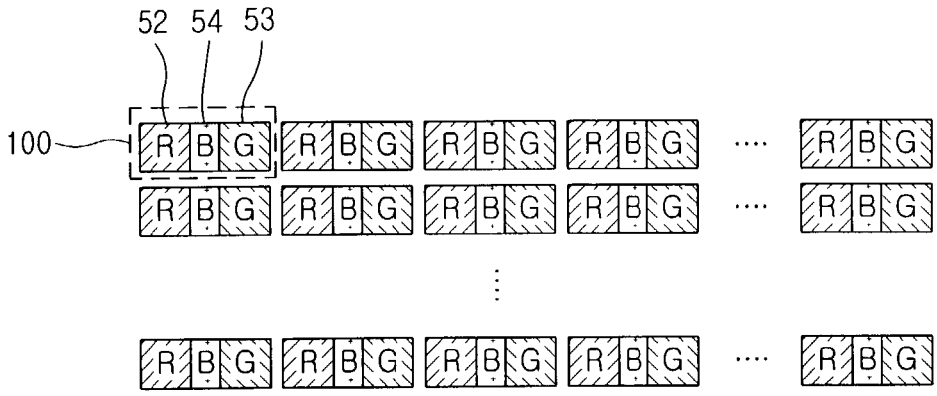
FIG. 6 is a drawing illustrating overlapped inorganic materials (fluorescent material) of FIGS. 5A and 5B.

FIG. 6 is a drawing illustrating overlapped inorganic materials (fluorescent material) of FIGS. 5A and 5B.

As shown in FIG. 6, the fluorescent materials 52, 53 and 54 formed at the active display surface 45 are overlapped within the active display surface 45.

For example, The blue (B) fluorescent material 54 formed in one cell 61 of the second substrate 46 is overlapped between the red (R) and green (G) fluorescent materials 52 and 53 formed in one cell 51 of the first substrate 43.

That is, one cell 51 of the first substrate 43 and one cell 61 of the second substrate 46 are overlapped in the active display surface, to form one pixel cell 100.

In this manner, the fluorescent materials 52, 53 and 54 are installed overlapped at the EL panel, so that various color picture can be displayed.

Meanwhile, a third pad 44 and a fourth pad 47 are installed at a region other than the active display surface 45 of the second substrate 46. The fourth pad 47 is formed at one portion of the second substrate 46 and electrically connected with the data lines (not shown). The fourth pad 47 receives a data pulse from the data driving units (72, 73 and 75 in FIG. 7).

The third pad 44 is formed at one portion of the second substrate 46 and electrically connected with the scan lines formed in a direction of being crossed with the data lines.

The third pad 47 sequentially receives the scan pulse from the scan driving units (71 and 74 in FIG. 7). A driving unit for driving the EL panel of the present invention will now be described with reference to FIG. 7.

FIG. 7 is a drawing illustrating a driving unit of the inorganic EL panel in accordance with the preferred embodiment of the present invention.

As shown in FIG. 7, a driving unit of an inorganic EL panel in accordance with the present invention includes: a red data driving unit 72 for supplying a data pulse to the first data line formed to be overlapped with the red (R) fluorescent material 52 formed in one cell 51 of the first substrate 43; a green data driving unit 73 for supplying a data pulse to the first data line formed to be overlapped with the green (G) fluorescent material 53 formed in one cell 51 of the first substrate 43; a blue data driving unit 75 for supplying a data pulse to the second data line formed to be overlapped with the blue (B) fluorescent material 54 formed in one cell 61 of the second substrate 46 overlapped with the first substrate 43; and first and second scan driving units 71 and 74 for supplying a scan pulse to the second pad 41 electrically connected with the first data line and the third pad 44 electrically connected with the second data line.

The blue (B) fluorescent material 54 formed in one cell 61 of the second substrate 46 is overlapped in its certain portion between the red (R) and green (G) fluorescent materials 52 and 53 formed in one cell 51 of the first substrate 43.

The operation of the inorganic EL panel of the present invention will now be described with reference to FIGS. 8 and 9.

Figure 8:
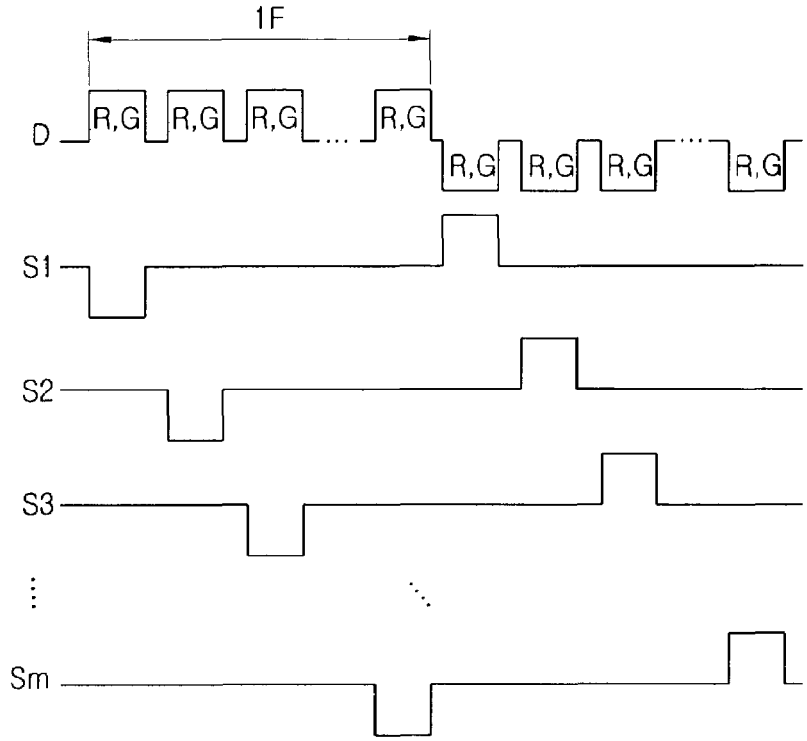
FIGS. 8 and 9 are waveforms applied to the first and second substrates according to operations of driving units of the EL panel of FIG. 7.
Figure 9:
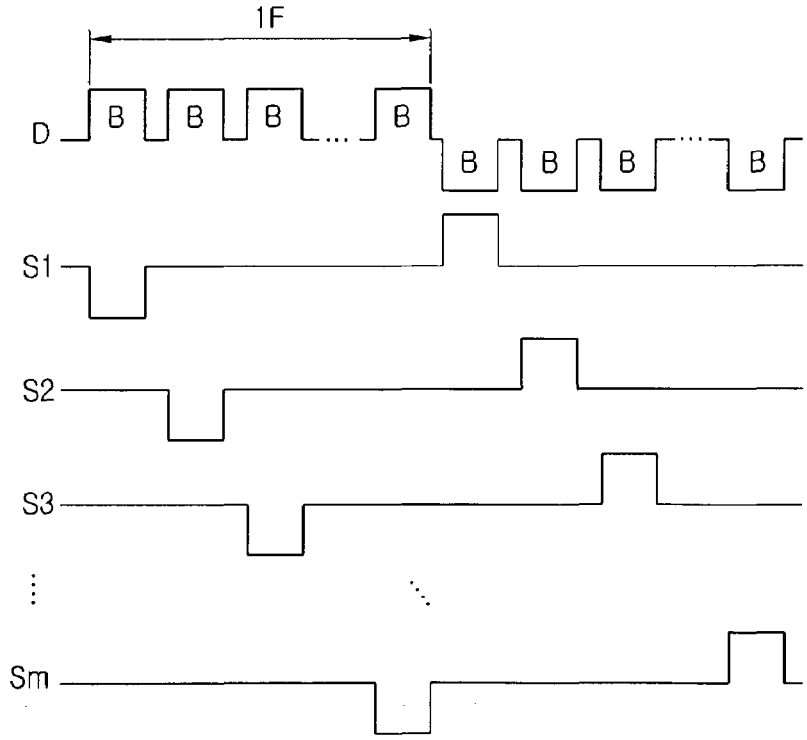

FIGS. 8 and 9 are waveforms applied to the first and second substrates according to operations of driving units of the EL panel of FIG. 7.

First, the first scan driving unit 71 sequentially supplies a scan pulse to the second pad 41 formed on the first substrate 43. As shown in FIG. 8, the scan pulse is supplied to the scan lines (S1~Sm) that is formed at the first substrate 43 and goes through the red (R) and the green (G) fluorescent materials 52 and 53.

The red data driving unit 72 supplies a data pulse synchronized with the scan pulse to the first pad 42 connected with the red (R) fluorescent material 70, or to the fluorescent material 70 connected with the data lines D1~Dn.

The green data driving unit 73 supplies a data pulse synchronized with the scan pulse to the first pad 42 connected with the green (G) fluorescent material 53, or to the fluorescent material 53 connected with the data lines D1~Dn.

At this time, upon receiving the scan pulse and the data pulse, the fluorescent material emits a light according to the data pulse.

In this respect, as shown in FIG. 8, the scan pulse and the data pulse are inverted for every frame and supplied. That is, in order to prevent a damage of the fluorescent materials 52 and 53 made of an inorganic material, the scan pulse and the data pulse are inverted for every frame (1F) and supplied.

The second scan driving unit 74 sequentially supplies the scan pulse to the third pad 44 formed at the second substrate 46.

And, as shown in FIG. 9, the scan pulse is supplied to the scan lines S1~Sm going through the blue (B) fluorescent material 54 formed at the second substrate 46.

The blue data driving unit 75 supplies a data pulse synchronized with a scan pulse to the fourth pad 47 connected with the blue (B) fluorescent material 54, or to the blue fluorescent material (54) connected with the data lines D1~Dn. At this time, upon receiving the scan pulse and the data pulse, the blue (B) fluorescent material 54 emits a light according to the data pulse.

The scan lines (that is, second and third pad 41 and 44) formed at the first and second substrates 43 and 46 simultaneously receive the scan pulse and the data pulse together. That is, the first and second scan driving units 71 and 74 simultaneously supplies mutually synchronized scan pulses to the scan lines (that is, the second and third pads 41 and 44).

As shown in FIG. 9, the scan pulse and the data pulse are inverted for every frame (1F) and supplied. That is, in order to prevent damage of the fluorescent material 54 made of an inorganic material, the scan pulse and the data pulse are inverted for every frame (1F) and supplied.

Figure 10:
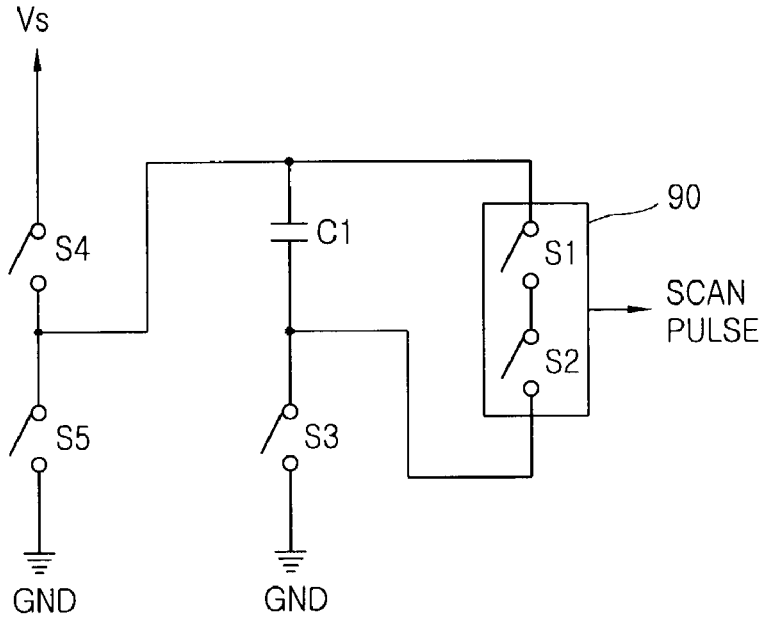
FIG. 10 is a detailed circuit diagram showing a scan driving unit in accordance with the preferred embodiment of the present invention.

FIG. 10 is a detailed circuit diagram showing a scan driving unit in accordance with the preferred embodiment of the present invention.

As shown in FIG. 10, the first and second driving units 71 and 74 of the present invention includes: a scan drive integrated circuit (IC) 90 for selecting scan lines (S1~Sm) to which a scan pulse is to be supplied; a fourth switch S4 installed between the scan drive IC 90 and a scan voltage source (Vs); a fifth switch S5 installed between the fourth switch S4 and a ground voltage source (GND); a capacitor C1 installed in parallel at the scan drive IC 90; and a third switch S3 installed between the capacitor C1 and the ground voltage source (GND).

A plurality of scan lines S1~Sm are connected with the scan chive IC 90. That is, first and second switches S1 and S2 are installed at each of the scan lines S1~Sm. The switches S1~S5 are operated by a control signal supplied from a controller (not shown).

The operation of the scan driving units of the present invention will now be described in detail.

First, the third and fourth switches S3 and S4 are turned on by a control signal supplied from the controller. When the third and fourth switches S3 and S4 are turned on, the voltage of the scan voltage source Vs is charged in the capacitor C1.

The voltage charged in the capacitor C1 is supplied to the scan drive IC 90, and the scan drive IC 90 sequentially supplies a scan pulse to the scan lines S1~Sm. At this time, a positive (+plus) scan pulse is supplied to the scan lines S1~Sm.

Thereafter, after the fourth switch S4 and the third switch S3 are turned on, the fifth switch S5 is turned on. When the fifth switch S5 is turned on, the voltage charged in the capacitor C1 is inverted to a negative (−minus) voltage.

That is, when only the fifth switch S5 is turned on, one end of the capacitor C1 is connected with the ground voltage source (GND) and the other end is maintained in a floating state.

Namely, the voltage charged in the capacitor C1 is not discharged and the voltage of the ground voltage source (GND) is lowered down. Thus, the negative (−minus) voltage charged in the capacitor C1 is supplied to the scan drive IC 90 and the scan drive IC 90 sequentially supplies the scan pulse to the scan lines S1~Sm. At this time, the negative (−minus) scan pulse is supplied to the scan lines S1~Sm.

Figure 11:
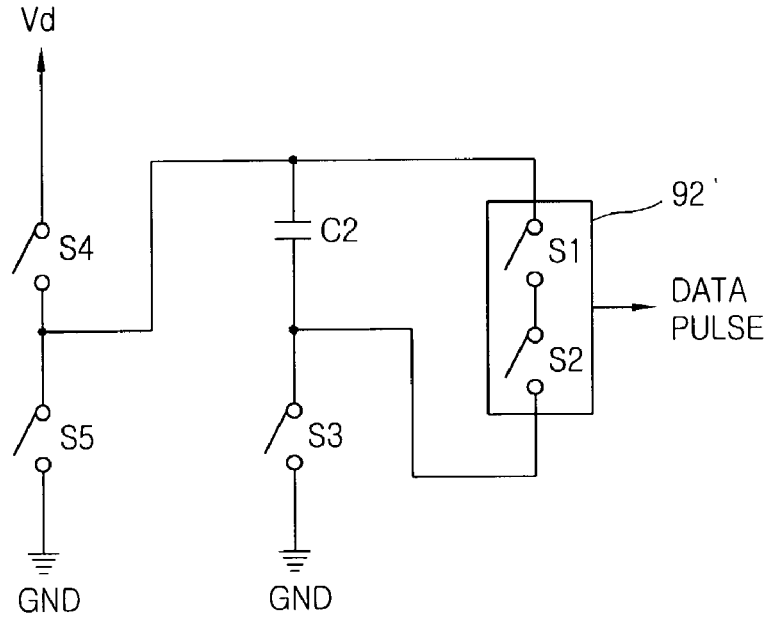
FIG. 11 is a detailed circuit diagram showing a data driving unit in accordance with the preferred embodiment of the present invention.

FIG. 11 is a detailed circuit diagram showing a data driving unit in accordance with the preferred embodiment of the present invention.

As shown in FIG. 11, the data driving units 72, 73 and 75 of the present invention respectively include: a data drive IC 92 for activating every data line D1~Dn; a fourth switch S4 installed between the data drive IC 92 and a data voltage source Vd; a fifth switch S5 installed between the fourth switch S4 and the ground voltage source (GND); a capacitor C2 installed in parallel at the data drive IC 92; and a third switch S3 installed between the capacitor C2 and the ground voltage source (GND).

The data drive IC 92 is connected with a plurality of the data liens D1~Dn. That is, first and second switches S1 and S2 are installed at each of the data lines D1~Dn.

The operation of the data driving unit will now be described in detail.

First, when the data drive IC 92 receives a data, it activates the data lines D1~Dn. That is, the data drive IC 92 connects the data lines D1~Dn to the capacitor C2 if the data is supplied to the data drive IC 92.

The switches S1~S5 are operated by a control signal supplied from a controller (not shown). The operations of the data driving units 72, 73 and 75 are the same as that of the scan driving units 71 and 74 as shown in FIG. 10.

When the negative (−minus) scan pulse is supplied to the scan lines S1~Sm, the data driving units 72, 73 and 75 supplies a positive (+plus) data pulse synchronized with the negative (−minus) scan pulse to the data lines D1~Dn.

When a positive (+plus) scan pulse is supplied to the scan lines S1~Sm, the data driving units 72, 73 and 75 supplies a negative (−minus) data pulse synchronized with the positive (+plus) scan pulse to the data lines D1~Dn.

As so far described, the EL panel display apparatus and its driving method have many advantages.

That is, for example, the size of the blue fluorescent material is set larger than that of the red and green fluorescent materials, so that its luminance can be improved. That is, the luminance can be improved by forming the red and green fluorescent materials having a higher luminance than that of the blue fluorescent material at the first substrate and forming the blue fluorescent material having the relatively low luminance at the second substrate.

In addition, since the luminance of the blue fluorescent material is improved, a color balance can be easily set.

Moreover, since the blue fluorescent material is set large, the life span of the blue fluorescent material is increased, and accordingly, the life span of an inorganic EL panel can be improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. An electroluminescence (EL) panel display comprising:

a first substrate on which cells comprising blue fluorescent material are formed in a matrix pattern;

a second substrate overlapped with the first substrate, wherein cells comprising red and green fluorescent materials are formed in a matrix pattern on the second substrate;

a first data line formed on the first substrate so as to be electrically connected to the red and green fluorescent materials;

a first scan line electrically connected to the red and green fluorescent materials in a direction perpendicular to the first data line;

a second data line formed on the second substrate so as to be electrically connected to the blue fluorescent material;

a second scan line electrically connected to the blue fluorescent material in a direction perpendicular to the second data line;

a first data driving unit for supplying a data pulse to the first data line;

a second data driving unit for supplying the data pulse to the second data line; and a scan driving unit for sequentially supplying a scan pulse in synchronization with the data pulse to the first and second scan lines.

2. The panel display of claim 1, wherein the cells comprising the blue fluorescent material and the cells comprising the red and green fluorescent materials are mutually overlapped to form one cell.

3. The panel display of claim 1, wherein a predetermined portion of the blue fluorescent material is overlapped by the red and green fluorescent material.

4. The panel display of claim 1, wherein a size of the blue fluorescent material is greater than or equal to a combined size of the red and green fluorescent materials.

5. The panel display of claim 1, wherein a polarity of the scan pulse supplied to the first and second scan lines is inverted for every frame and a polarity of the data pulse supplied to the first and second data lines is different than the polarity of the scan pulse.

6. A driving method of an EL panel comprising a first substrate having cells comprising a blue inorganic material formed thereon; a second substrate overlapped with the first substrate and having cells comprising red and green inorganic materials formed thereon; a first data line formed on the first substrate so as to overlap the red and green inorganic materials; a first scan line formed to overlap the red and green inorganic materials in a direction perpendicular to the first data line; a second data line formed on the second substrate so as to overlap the blue inorganic material, and a second scan line formed to overlap the blue inorganic material in a direction perpendicular to the second data line, the driving method comprising:

sequentially supplying the scan pulse to the first and second scan lines; and supplying the data pulse to the first and second data lines so as to be synchronized with the scan pulse.

7. The method of claim 6, wherein a polarity of the scan pulse supplied to the first and second scan lines is inverted for every frame and a polarity of the data pulse supplied to the first and second data lines is different than the polarity of the scan pulse.

8. An electroluminescence (EL) panel, comprising:

a first substrate having a plurality of red and green inorganic materials formed thereon;

a second substrate having a plurality of blue inorganic materials and positioned so that the plurality of blue inorganic materials and the plurality of red and green inorganic materials overlap each other;

a first data line formed on the first substrate so as to overlap the red and green inorganic materials;

a first scan line formed to overlap the red and green inorganic materials in a direction perpendicular to the first data line;

a second data line formed on the second substrate so as to overlap the blue inorganic material; and a second scan line formed to overlap the blue inorganic material in a direction perpendicular to the second data line.

9. The panel of claim 8, further comprising:

a first data driving unit for supplying a data pulse to the first data line;

a second data driving unit for supplying the data pulse to the second data line; and a scan driving unit for sequentially supplying a scan pulse in synchronization with the data pulse to the first and second scan lines.

10. The panel of claim 8, further comprising:

a first pad electrically connected to the first and second data lines; and a second pad electrically connected to the first and second scan lines.

11. The panel of claim 10, further comprising:

a first data driving unit for supplying a data pulse to the first pad electrically connected to the first data line;

a second data driving unit for supplying the data pulse to the second pad electrically connected to the second data line; and a scan driving unit for sequentially supplying a scan pulse synchronized with the data pulse to a third pad electrically connected to the first and second scan lines.

12. The panel of claim 11, wherein a polarity of the scan pulse supplied to the first and second scan lines is inverted for every frame and a polarity of the data pulse supplied to the first and second data lines is different than the polarity of the scan pulse.

13. An electroluminescence (EL) panel, comprising:

a first substrate comprising cells of blue fluorescent material formed in a matrix pattern;

a second substrate overlapped with the first substrate and comprising cells of red and green fluorescent materials formed in a matrix pattern;

a first data line formed on a first substrate so as to overlap the red and green fluorescent materials;

a first scan line formed to overlap the red and green fluorescent materials in a direction perpendicular to the first data line;

a second data line formed on a second substrate so as to overlap blue fluorescent material; and a second scan line formed to overlap the blue fluorescent material in a direction perpendicular to the second data line.

14. The panel display of claim 13, further comprising:

a first data driving unit for supplying a data pulse to the first data line;

a second data driving unit for supplying the data pulse to the second data line; and a scan driving unit for sequentially supplying a scan pulse in synchronization with the data pulse to the first and second scan lines.

15. The panel display of claim 14, further comprising:

a first pad electrically connected to the first and second data lines; and a second pad electrically connected to the first and second scan lines.

16. The panel display of claim 15, further comprising:

a first data driving unit for supplying a data pulse to the first pad electrically connected to the first data line;

a second data driving unit for supplying the data pulse to the second pad electrically connected to the second data line; and a scan driving unit for sequentially supplying a scan pulse synchronized with the data pulse to a third pad electrically connected to the first and second scan lines.

17. The panel display of claim 16, wherein a polarity of the scan pulse supplied to the first and second scan lines is inverted for every frame and a polarity of the data pulse supplied to the first and second data lines is different than the polarity of the scan pulse.

* * * * *